US005294284A

United States Patent [19]

Papulski

[11] Patent Number: 5,294,284

[45] Date of Patent: Mar. 15, 1994

[54] HEAT SHIELD FOR CARPET SEAMING IRON

[75] Inventor: Keith A. Papulski, Pleasanton, Calif.

[73] Assignee: Roofing Equipment, Inc., San Leandro, Calif.

[21] Appl. No.: 952,294

[22] Filed: Sep. 28, 1992

[51] Int. Cl.[5] ..... D06F 75/08; D06F 79/00

[52] U.S. Cl. ..... 156/574; 156/579; 156/583.1; 38/89; 38/95; 219/245

[58] Field of Search ..... 156/304.4, 304.6, 304.7, 156/379, 579, 583.1, 574; 38/75, 88, 89, 94, 95; 219/245

[56] References Cited

U.S. PATENT DOCUMENTS

| | | | |
|---|---|---|---|
| 191,935 | 6/1877 | Cluxton | 38/95 |
| 279,971 | 6/1883 | Muller | 38/95 |
| 2,095,954 | 10/1936 | Beck | 38/81 |
| 3,523,176 | 12/1967 | Hill | 219/245 |
| 4,536,244 | 8/1985 | Greci et al. | 156/304.4 |
| 5,028,295 | 7/1991 | Cracchiolo | 156/574 |

*Primary Examiner*—David A. Simmons
*Assistant Examiner*—J. Sells
*Attorney, Agent, or Firm*—Thomas M. Freiburger

[57] ABSTRACT

A heat shield for the upper surface of a carpet seaming tape iron, preferably formed of polytetrafluorethylene or other heat resistant synthetic material, covers only so much of the upper surface of the iron as is needed to assure that the carpet backing coming into contact with the iron will not be overheated. Since some heating of the carpet backing is desirable in the hot melt carpet seaming tape operation, the forward and rear surfaces of the iron are left at least partially exposed so that the carpet backing will have some direct contact with the hot metal heat transferring surface at the top of the iron's body. The heat shield is contoured so as to fit closely down against the surfaces of the carpet seaming tape iron, avoiding any unnecessary deflection of the carpet edges during the seaming operation and providing an integral feel to the assembly. Assembly may be as original equipment or as a retrofittable addition to an iron.

8 Claims, 3 Drawing Sheets

HEAT SHIELD FOR CARPET SEAMING IRON

BACKGROUND OF THE INVENTION

The invention relates to carpeting tools, and more specifically to carpet seaming tape irons used for seaming carpet edges in the well known conventional manner, using hot melt carpet seaming tape.

Heat shields of polytetrafluorethylene material (Teflon, a trademark of DuPont), for fitting onto a carpet seaming tape iron, are well known. It is known that the Teflon material produces a low-friction glide against the carpet backing as the iron is advanced during the seaming operation. Also, Teflon is quite heat resistant and somewhat insulative as are many plastic materials, and with the Teflon heat shield lying over the existing stainless steel heat shield of the iron, the carpet is insulated from contact with the hot metal heat shield. This purpose of the known heat shields has been to prevent overheating of the carpet backing which can destroy the integrity of the carpet backing and/or the seam formed during the hot melt seaming operation. A typical add-on heat shield for fitting onto existing irons has been marketed by Roofing Equipment Inc., 11075 E. 47th Avenue, Denver, Colo.; and also by Orcon Corporation of Union City, Calif. This heat shield device had a pair of legs forming a slot between them, with the front ends of the legs riveted together. Such construction provided an opening which could be positioned over the handle of an existing iron, so that the heat shield could be assembled down over the handle. The legs at the front end enabled some pivoting at this point about the rivet, adding to the flexibility of the slot when installed over the iron's handle.

One problem with such conventional retrofittable heat shields has been that, even though the heat shield was formed in a nonplanar, somewhat contoured configuration, the heat shield did not fit down closely over the upper surface of the iron and tended to lie on the iron with edges riding considerably upward from the iron's metal heat shield. Another problem of such heat shields has been their length, generally co-extensive with the back end of the iron's upper surface and extending nearly to the front of the iron. Extension of the heat shield in front of and behind the handle was necessary due to the manner in which the heat shield was installed on the iron—by fitting a slot over the iron's handle. Material was required forward of the handle and rearward of the handle for adequate integrity of the structure—to receive a rivet on the one end, and to form an adequate juncture at the other end to hold the heat shield together.

Irons in other fields have also employed heat shields or protective insulative layers, usually to protect the user. In the field of flatirons, see U.S. Pat. Nos. 3,793,753, 2,579,726, 2,095,954, 626,286, 279,971, 191,935, 142,334, 75,611 and 58,138.

Thus, prior carpet iron heat shields of the type described exhibited several problems—effectively raising the profile of the carpet seaming tape iron and hindering the installer; sometimes underheating the carpet backing during the seaming operation; and generally giving the appearance and feel of not fitting properly over the top of the seaming iron. These and additional problems are overcome by the heat shield of the present invention described below.

SUMMARY OF THE INVENTION

In accordance with the present invention, a heat shield for a carpet seaming tape iron conforms closely to the profile of the stainless steel heat shield forming the top surface of the iron, retaining the original low profile of the iron. The heat shield, which may be of polytetrafluorethylene as in prior retrofittable heat shields (or other appropriate plastics), is formed of one integral piece of material with openings at the location of the handle, so that it can be sandwiched between the bottom of the handle and the top of the body of the iron, i.e. against the metal primary heat shield which is part of the iron itself (generally formed of stainless steel).

Thus, instead of having a slot or bifurcation to be pushed down over the handle, the heat shield of the present invention fits underneath the handle and has appropriate openings for receiving those items which extend through the existing stainless steel heat shield and into the handle—handle connection flanges, wiring and a thermostat component. The heat shield may be installed on an existing iron by removal of handle screws and the handle, disconnection of wires, placement of the heat shield over the iron's body, reconnection of wires and replacement of the handle and screws. The Teflon material of the heat shield acts as a gasket surrounding all or most of the openings at the top of the iron's body, i.e. through the stainless steel heat shield, thereby eliminating a large gasket normally provided to surround these openings between the handle and the iron's body.

The heat shield of the invention is not coextensive with the length of the stainless steel heat shield at the top of the iron. Instead, at the front it terminates at or just beyond the front of the handle; at the rear end it terminates short of the end of the stainless steel heat shield, and in some iron configurations it does not extend as far back as the handle itself. In this way it enables a controlled heating of the carpet backing, the proper amount of heating for making a good seam. Overheating of the carpet backing is prevented by the heat shield, but the heat shield does not prevent adequate heating of the carpet backing, which could often occur with prior add-on heat shield devices.

The termination of the heat shield at a position forward of the rear portion of the iron is an important feature of the invention. At the back of the iron, where the primary stainless steel heat shield generally extends in a flat configuration which slopes downwardly toward the back end of the iron, it is important not to increase the height profile of the iron. Conventional plastic heat shields have covered this back area and have tended to increase the profile height by more than one-eighth inch. The higher profile hinders the carpet seaming operation in this critical area where the carpet edges are brought back together to be secured by the molten adhesive of the hot melt tape. By causing the carpet edges to be held higher in this area, the conventional plastic heat shields have held the carpet edges apart to a greater extent than is desireable. In the absence of any plastic heat shield added over the primary stainless steel heat shield, on a low profile iron such as described and shown herein, carpet edges will tend to come together about one-half inch farther forward than if a typical prior plastic heat shield were present. It is important to retain this forward position of seaming in that the adhesive has been freshly softened and the carpet edges should be laid into the adhesive as immediately behind the iron as possible. Further, increased accuracy of seaming is possible if the carpet edges come together immediately at the back of the iron. With the configuration of the insulative plastic heat of the present invention, the location where the edges come together is essentially maintained for the low profile seaming iron. The edges are permitted to come together approximately at the back extremity of the iron, or about one-fourth inch ahead of the back extremity.

It is therefore among the objects of the invention to greatly improve over prior polytetrafluorethylene heat shields for carpet seaming tape irons, by a heat shield structure which has a better appearance and feel to the installer, which appears and acts more as an integral part of the iron and which provides the proper amount of heating to the carpet backing during the carpet seaming operation. These and other objects, advantages and features of the invention will be apparent from the following description of a preferred embodiment, considered along with the accompanying drawings.

DESCRIPTION OF PREFERRED EMBODIMENTS

Figure 1:
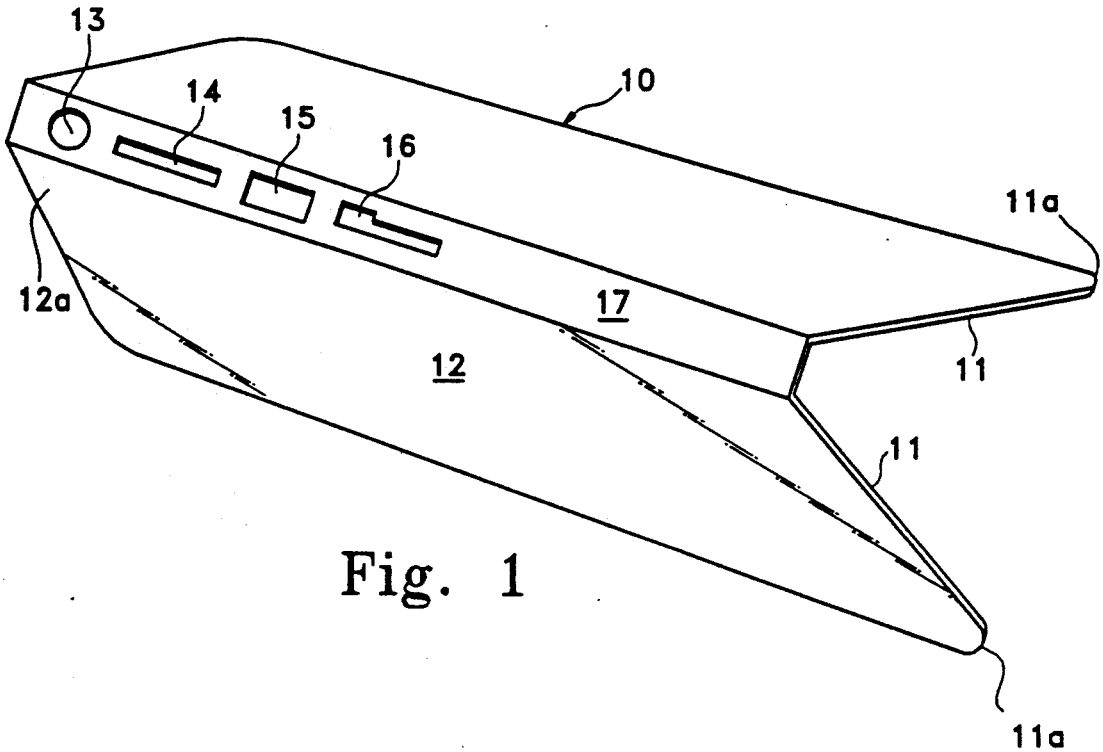
FIG. 1 is a view in perspective showing a heat shield according to the invention, for installation on a carpet seaming tape iron.

In the drawings, FIG. 1 shows a heat shield 10 in accordance with the principles of the invention, which may be made of polytetrafluorethylene or Teflon (a trademark of DuPont). Other plastics having good heat resistant properties, low friction characteristic against a carpet backing, some degree of insulation and the ability to be shaped to closely contour over a warped surface may be used.

Figure 2:
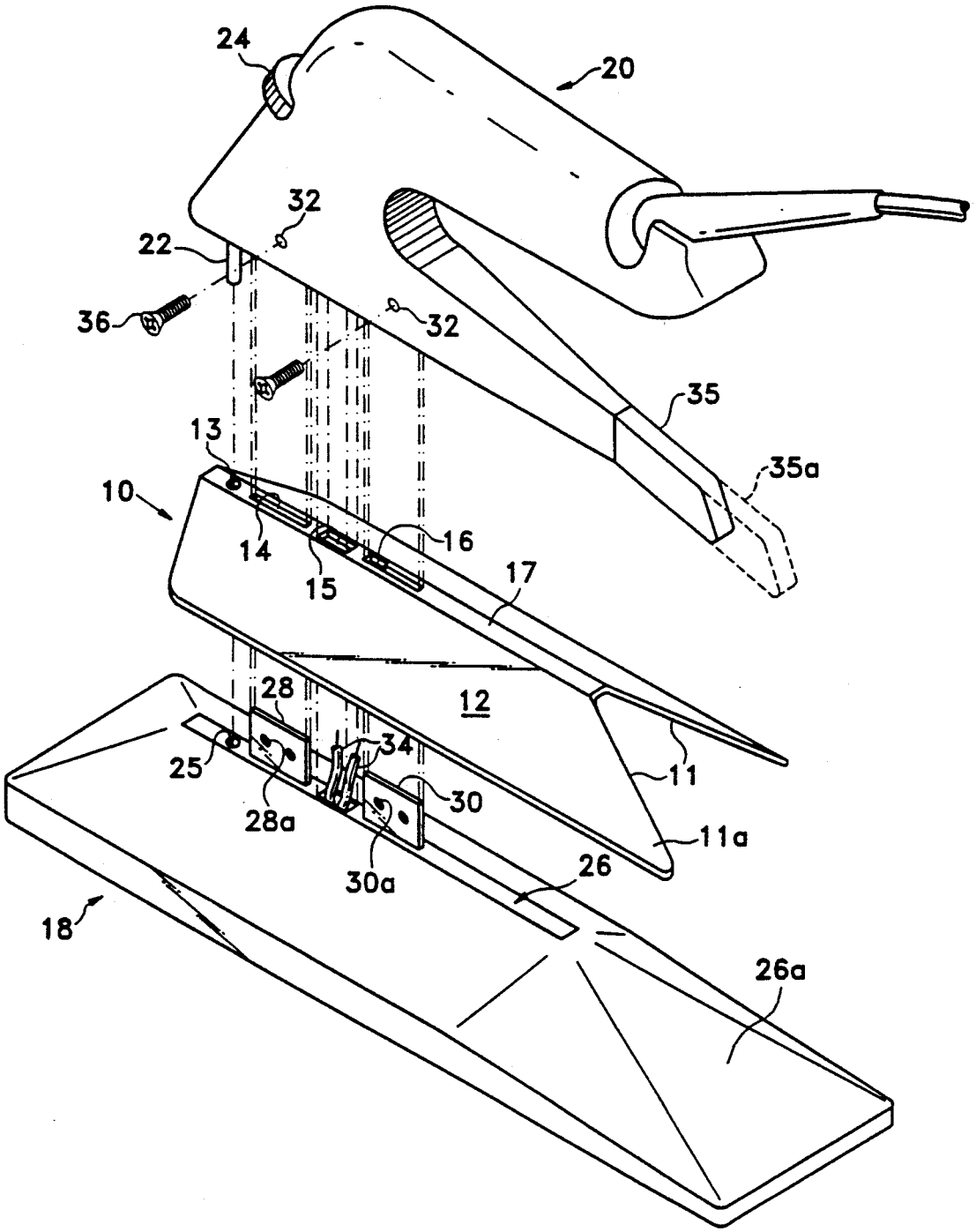
FIG. 2 is an exploded view showing a carpet seaming tape iron with its handle removed, and with the heat shield of the invention positioned to be assembled beneath the handle.

As seen in FIGS. 1 and 2, the heat shield 10 of the invention is contoured, i.e. cupped downwardly to fit closely over the top surface of a typical carpet seaming tape iron. The shapes of the existing stainless steel heat shields forming the top surface of the iron body are fairly consistent, therefore enabling a single size and shape of heat shield to have generally universal application. The contour can be slightly exaggerated so that the heat shield will conform even more tightly to the iron when it is installed beneath the handle. Thus, rear fins 11 on the heat shield may be shaped to curve downwardly and inwardly somewhat at tail ends 11*a*; also, the downward angularity of side flaps 12 (having the fins 11*a* at their ends) may be sharper than that of the corresponding iron surfaces over which the heat shield will be installed, so that the side flaps 12 will be held closely against those surfaces (see FIGS. 2 and 3).

As illustrated in the drawing figures, the heat shield 10 is a solid piece of material of generally uniform thickness, preferably having a series of openings 13, 14, 15 and 16 through its top surface 17. The openings 13 through 16, as shown in the exploded view of FIG. 2, receive various structures which connect between the body 18 and the handle 20 of the iron. These include a thermostat connection 22 from the handle portion, associated with a heat setting dial 24, which passes through the opening 13 and extends into a corresponding opening 25 through the stainless steel heat shield 26; a pair of connecting flanges or uprights 28 and 30 which extend up into the handle through the slotted openings 14 and 16 in the heat shield of the invention; and electrical wires 34 which extend up through the opening 15 in the heat shield 10, to be connected to power and heat control in the handle assembly 20. These features are typical of Roberts and Orcon irons. Others could appear on the market requiring a somewhat different pattern of openings in the heat shield 10.

FIG. 2 generally indicates a Roberts type iron, with a foreshortened handle tail piece 35. Orcon irons typically have had an extended handle tail as indicated at 35*a* in FIG. 2. The shield 10 of the invention is compatible with both.

As illustrated in FIG. 2, with screws removed from the screw holes 32 of the handle, the handle is removed, the wires 34 are disconnected and the heat shield 10 is placed down over the body 18 of the iron, against the existing stainless steel heat shield 26 which forms the top surface of the body. After the wiring 34 has been reconnected into the handle, the handle 20 is then placed down against the Teflon heat shield 10 and screws 36 (FIG. 3) are reinstalled. The screws 36, preferably machine screws, are inserted horizontally through the handle screw holes 36 to engage in threaded bores 28*a* and 30*a* of the connection flanges 28 and 30. A similar pair of screws generally is included to extend into the handle from the opposite direction, offset from the screws 36 to be received in similar threaded bores of the connection uprights 28 and 30.

It can therefore be seen that the somewhat pliable Teflon material of the heat shield 10 acts as a gasket surrounding the openings 13, 14, 15 and 16 in the iron. This eliminates a large silicone gasket which was typically provided between the handle 20 and the stainless steel heat shield 26 to prevent liquid (hot melt adhesive) from entering the interior of the iron, which is an important consideration in original equipment manufacture. The heat shield 10 also acts as a better heat insulator than the conventional silicone gasket greatly reducing the handle temperature.

Figure 3:
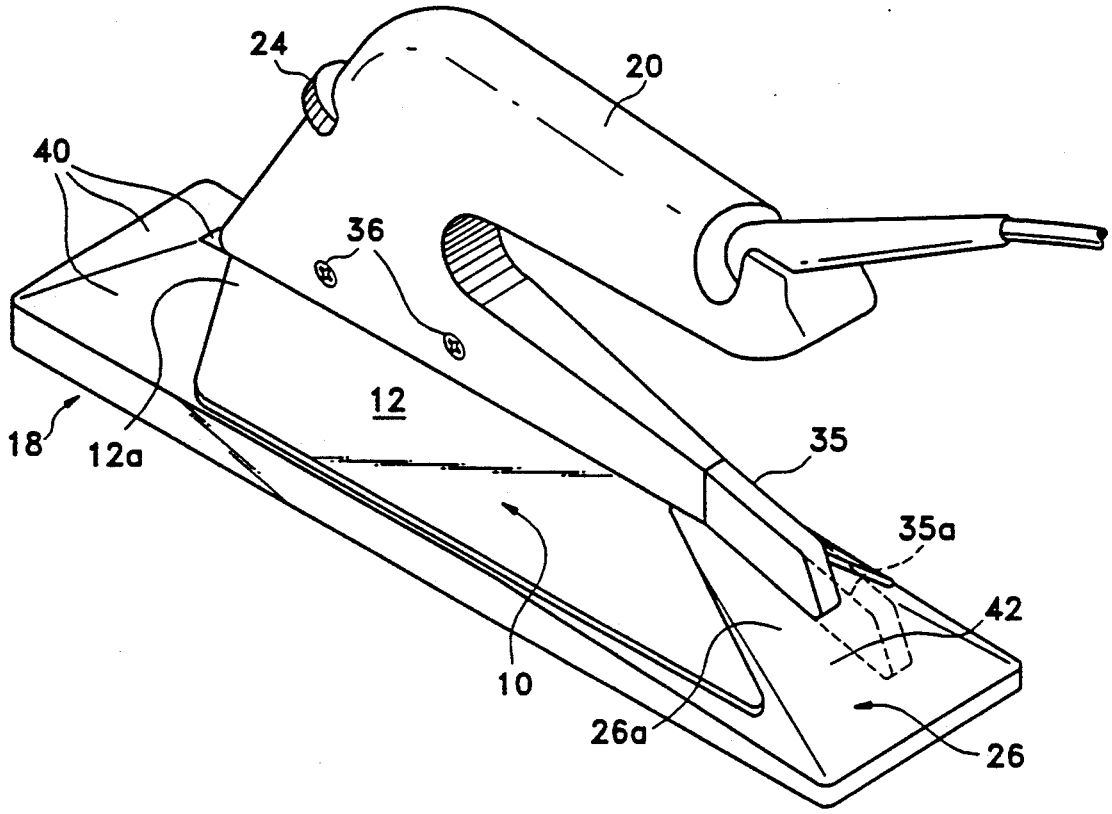
FIG. 3 is a view showing the fully assembled carpet seaming tape iron including the heat shield.

FIG. 3 shows the heat shield 10 of the invention as installed on the iron, sandwiched tightly between the handle 20 and the stainless steel heat shield 26 of the iron body. The iron can be factory-assembled in this configuration, including the heat shield 10.

In contrast with prior slip-on heat shields, it can be seen that the heat shield 10 conforms closely to the upper surface of the iron, over the stainless steel heat shield 26 of the iron. Also, FIGS. 2 and 3 show that the heat shield 10 is shorter than the length of the stainless steel heat shield, thereby exposing front and rear areas 40 and 42 of the iron's stainless steel heat shield. As discussed previously, this assures that the carpet backing will be adequately heated during the carpet seaming operation, rather than being insulated against the entire length of the iron as in prior conventional slip-on heat shield structures. As discussed above, it is particularly important at the tapered back surface 26*a* of the iron (on a low-profile iron such as shown) to maintain the low profile and not add height to this profile as would be the case with prior insulative plastic heat shields. It can be seen from the drawings that this tapered, generally flat area 26a is maintained in its low profile by the configuration of the heat shield 10 of the invention.

As can be seen from FIGS. 1, 2 and 3, the Teflon heat shield 10 of the invention preferably is shaped with rear fins 11 which leave open a large central area 42 at the rear of the iron's stainless steel heat shield. At the front of the iron, the side flaps 12 of the stainless steel heat shield may be angled back in a sweeping configuration as shown at the edges 12a, to provide a controlled area 40 of exposure of the stainless steel heat shield at the front end.

In a preferred embodiment, the heat shield 10 of the invention will leave exposed about five square inches (3 to 6 square inches more generally) of the stainless steel heat shield 26 in front of the handle, and about 8 square inches (6 to 9 square inches more generally) at the rear end of the iron. More broadly speaking, at the front of the handle a distance of about one inch to two inches is left exposed, and at the rear, in the range of about three inches to four inches. Stated in terms of area, approximately 35% to 40% of the total upper surface of the iron's body is left exposed for contact against the carpet backing. Of the total exposed area, somewhat more may be at the rear than at the front. At the rear, maintaining the profile height of the iron is an important consideration.

The drawings show a preferred embodiment wherein the shield 10 essentially does not extend forward of the handle 20. At the rear of the iron the shield 10 may terminate forward of the rear end of the handle, as shown, for models having a central fin-like tail extension 35 or 35a on the handle.

Figure 4:
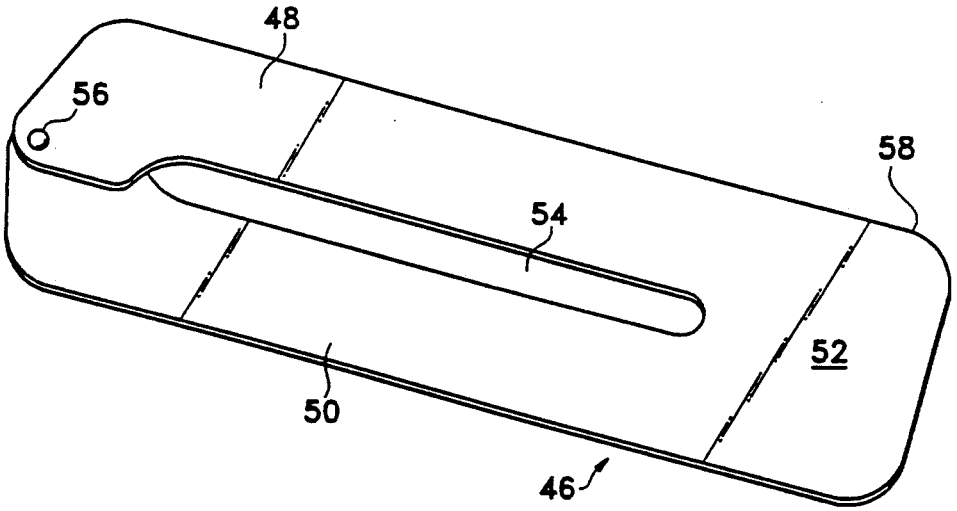
Fig. 4 (PRIOR ART)
FIG. 4 is a plan view showing a heat shield of the prior art.

FIG. 4 shows the prior art Teflon heat shield 46 described above. The heat shield 46 was formed of a single sheet of material, but was bifurcated, with two legs 48 and 50, which extended forward from a common generally flat area 52 at the rear. They formed an elongated central slot 54 via which the heat shield 46 was assembled down over the handle of an iron. A rivet 56 was used to connect the two legs 48 and 50 at their front ends, providing a needed front connection and giving some flexibility as to opening of the slotted hole 54 on assembly. It is emphasized that the rear end 58 of the prior art heat shield 46 extended over and covered essentially the entire rear end of the metal heat shield of the iron (with disadvantages in heating and in profile height as discussed above). Similarly, the front end of the heat shield 46 extended over substantially all of the front end of the metal body of the iron. As pointed out above, the heat shield 10 of the invention differs markedly from the prior art heat shield in these respects.

It is therefore seen that the new heat shield of the invention is easily installed, becomes a more integral part of the iron, fits closely over the iron's hot surface, preserves the low-profile rear area of the iron, and delivers a controlled amount of heat to the carpet backing. If any damage occurs to the heat shield, or if excessive hot melt adhesive affects the heat shield, it may easily be removed and replaced as described above.

It should be pointed out that the invention encompasses not only a separate heat shield component 10 as shown in the drawings and described above, but also a plastic heat shield of the same general configuration but formed as an integral part of the iron's handle 20. The heat shield can be integrally molded with the handle 20, so long as the handle is of an appropriate plastic material which is somewhat insulative; or it can be formed separately from the handle but interconnected with the components of the handle in such a way that it cannot be separated in the configuration as shown in the drawings.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A heat shield for a carpet seaming tape iron which includes a body having a metal heat transferring surface forming the top surface of the body and a handle extending up from the body, the heat shield being adapted to fit against the metal heat transferring surface of the iron, comprising:

a sheet of somewhat pliable, heat-resistant plastic material, having a generally flat central section as an upper surface and a pair of side flaps angling downwardly and outwardly from the central section, generally at a similar angle to that of corresponding surfaces on the metal heat transferring surface of the iron, the length of the sheet of material being limited at front and back so as to extend less than the length of the metal heat transferring surface when installed between the handle and the body, leaving exposed a front portion as well as a rear portion of the metal heat transferring surface, with the side flaps of the heat shield angling back from the front of the iron's handle to expose an adequate portion of the metal heat transferring surface at the front of the iron, whereby the profile at the rear of the metal heat transferring surface is essentially not raised by the plastic heat shield, and whereby the metal heat transferring surface makes adequate contact with carpet backing to heat the carpet backing properly during a hot melt carpet seaming operation.

2. A heat shield for a carpet seaming tape iron which includes a body having a metal heat transferring surface forming the top surface of the body and a handle extending up from the body, the heat shield being adapted to fit against the metal heat transferring surface of the iron, comprising:

a sheet of somewhat pliable, heat-resistant plastic material, having a generally flat central section as an upper surface and a pair of side flaps angling downwardly and outwardly from the central section, generally at a similar angle to that of corresponding surfaces on the metal heat transferring surface of the iron, the length of the sheet of material being limited at front and back so as to extend less than the length of the metal heat transferring surface when installed between the handle and the body, leaving exposed a front portion as well as a rear portion of the metal heat transferring surface, with the side flaps tapering into a pair of spaced fin-like extensions of the rear of the heat shield, to expose an adequate portion of the metal heat transferring surface at the rear of the iron, whereby the profile at the rear of the metal heat transferring surface is essentially not raised by the plastic heat shield, and whereby the metal heat transferring surface makes adequate contact with carpet backing to heat the carpet backing properly during a hot melt carpet seaming operation.

3. In a carpet seaming tape iron which includes a body having a metal heat transferring surface forming the top surface of the body and a handle extending up from the body, an improved plastic heat shield which extends over the metal heat transferring surface to limit heating of carpet backing coming into contact with the iron, comprising:

a pair of side flaps of pliable, heat-resistant material, extending generally angularly downwardly on either side of the iron from the handle, the plastic heat shield being contoured so as to be generally cupped downwardly in a shape which will conform essentially to the top surface of the body of the carpet seaming tape iron, against the metal heat transferring surface of the iron, and the length of the plastic heat shield being limited at front and back so as to extend less than the length of the metal heat transferring surface, leaving exposed a front portion as well as rear portion of the metal heat transferring surface, whereby the profile at the rear of the metal heat transferring surface is essentially not raised by the plastic heat shield and whereby the metal heat transferring surface makes adequate contact with carpet backing to heat the carpet backing properly during a hot melt carpet seaming operation.

4. The heat shield of claim 3, wherein the length of the heat shield is such that approximately 3 to 6 square inches of the metal heat transferring surface are left exposed at the front of the iron.

5. The heat shield of claim 3, wherein the length of the heat shield is such that approximately 6 to 9 square inches of the metal heat transferring surface are left exposed at the rear of the iron.

6. The heat shield of claim 3, wherein the side flaps of the heat shield angle back from the front of the iron's handle to expose an adequate portion of the metal heat transferring surface at the front of the iron.

7. The heat shield of claim 3, wherein the side flaps taper into a pair of spaced fin-like extension of the rear of the heat shield, to expose an adequate portion of the metal heat transferring surface at the rear of the iron.

8. The heat shield of claim 3, wherein the side flaps extend down from the central portion at a slightly sharper angle than the corresponding surfaces of the metal heat transferring surface of the iron.

* * * * *